US009074611B2

(12) United States Patent
Sauer et al.

(10) Patent No.: US 9,074,611 B2
(45) Date of Patent: Jul. 7, 2015

(54) WALL RING FOR AXIAL FAN

(75) Inventors: Thomas Sauer, Idstein (DE); Dieter Best, Ingelfingen (DE); Sven Beck, Krautheim (DE); Christian Weiss, Mulfingen-Zaisenhausen (DE)

(73) Assignee: ebm-papst Mulfingen GmbH & Co. KG, Mulfingen (DE)

( * ) Notice: Subject to any disclaimer, the term of this patent is extended or adjusted under 35 U.S.C. 154(b) by 514 days.

(21) Appl. No.: 13/493,271

(22) Filed: Jun. 11, 2012

(65) Prior Publication Data

US 2013/0017073 A1 Jan. 17, 2013

(30) Foreign Application Priority Data

Jul. 12, 2011 (EP) ..... 11173522

(51) Int. Cl.
*F04D 29/52* (2006.01)
*F04D 29/64* (2006.01)

(52) U.S. Cl.
CPC ..... *F04D 29/646* (2013.01); *F04D 29/526* (2013.01)

(58) Field of Classification Search
CPC ... F04D 19/002; F04D 29/522; F04D 29/526; F04D 29/545; F04D 29/644; F04D 29/646
USPC ..... 403/331, 345, 365; 415/173.1, 213.1, 415/214.1, 215.1, 220, 222, 223; 416/169 A; 454/204, 271, 350, 354
See application file for complete search history.

(56) References Cited

U.S. PATENT DOCUMENTS

| | | | | |
|---|---|---|---|---|
| 4,018,297 | A * | 4/1977 | Haupt | 180/68.1 |
| 4,522,160 | A * | 6/1985 | Speers et al. | 123/41.49 |
| 4,741,669 | A | 5/1988 | Shimokawabe | |
| 2001/0021345 | A1 * | 9/2001 | Olthof | 415/220 |
| 2006/0067820 | A1 * | 3/2006 | Wang et al. | 415/220 |
| 2006/0081353 | A1 * | 4/2006 | Inniger et al. | 165/41 |
| 2011/0067845 | A1 | 3/2011 | Bishop | |

FOREIGN PATENT DOCUMENTS

WO WO 2011/044909 A1 4/2011

OTHER PUBLICATIONS

European Search Report—Dec. 29, 2011.

* cited by examiner

*Primary Examiner* — Dwayne J White
*Assistant Examiner* — Brian P Wolcott
(74) *Attorney, Agent, or Firm* — Brinks Gilson & Lione

(57) ABSTRACT

The invention relates to a wall ring for an axial fan comprised of a supporting frame (1) on which a circular connecting piece (2) is formed, inside which the axial fan is arranged. The supporting frame (1) is assembled from a plurality of frame elements (6) by means of form and force-fitting connecting elements. The circular connecting piece (2) is formed of a plurality of circular segments (22) arranged circumferentially one after the other, said circular segments being connected to each other and to the supporting frame (1) by means of form and force-fitting or material-bonded connections or by such connection elements, respectively.

19 Claims, 4 Drawing Sheets

WALL RING FOR AXIAL FAN

CROSS REFERENCE TO RELATED APPLICATION

This application claims priority to European Patent Application No. 11173522.1, filed Jul. 12, 2011.

FIELD OF THE INVENTION

The invention relates to a wall-ring for an axial fan comprising a supporting frame which is designed as having a circular connecting piece inside with the axial fan arranged therein.

BACKGROUND OF THE INVENTION

Wall-rings of the above mentioned type, which form a single-piece structural component, require, on the one hand, a large storage space, and on the other, considerable transport volume, and are expensive to manufacture due to the complex tools required for injection-molding of the wall-rings, which consist, for example, of plastic.

The present invention is based on the objective of creating a wall-ring of the type described above, whose manufacture, due to the use of simple tools, is more cost-effective, and which requires less space during storage and transport. Inventively, this is achieved by the supporting frame being assembled from a plurality of frame elements by means of form or force-fitting connecting elements, and the circular connecting piece being formed by a plurality of circular segments arranged circumferentially one after the other, said circular segments being connected to each other and to the supporting frame by means of form and force-fitting connections.

In accordance with the present invention, it is particularly advantageous if the supporting frame is comprised of four frame elements, and the circular connecting pieces of at least eight elements, and preferably twelve segments, so that the segments result in a 45°, or in a 30° division, respectively, of the circular connecting piece. Here it is particularly advantageous if the supporting frame has a rectangular, in particular a quadratic circumferential contour with four corners and a central opening whereby four enlarged corner areas are formed, and the frame elements are formed by means of a division corresponding to the two diagonals that run through the corners.

The division of the supporting frame into individual frame elements and the division of the circular connecting piece into a plurality of circular segments allows for highly space-saving storage and small transport volume, because the individual segments can be combined into segment packages, and assembly of the inventive wall-ring does not take place until the axial fan has been installed. The inventive form and force-fitting connections of the individual elements, or of the segments, respectively, to and among each other, enables firstly, a simple assembly of the individual parts, and in addition a very robust connection that can hold the required holding forces.

BRIEF DESCRIPTION OF THE DRAWINGS

Advantageous embodiments of the invention are shown in the dependent claims and will be explained in more detail on the basis of the accompanying drawings. They show:

DETAILED DESCRIPTION OF THE INVENTION

In FIGS. 1 to 10 the same parts, or parts with the same function, are identified by the same reference symbols. If certain described characteristics of the inventive wall-ring or its constituent parts or features of the inventive wall-ring and its constituent parts that can be inferred from the drawings are described in connection with only one exemplary embodiment, these features are nevertheless inventive, as individual features, independently of this embodiment, and in combination with other features of individual exemplary embodiments are considered essential to the invention and are thus claimed as an integral part of the invention.

Figure 1:
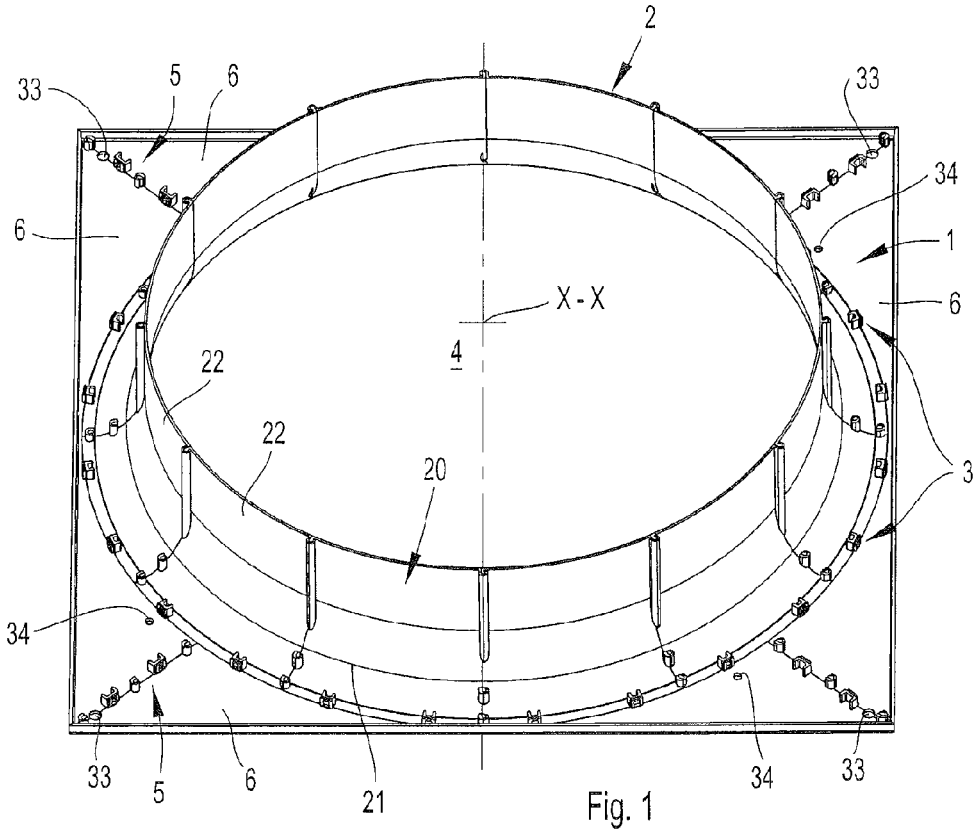
FIG. 1 is a perspective view of an inventive wall-ring.
Figure 2:
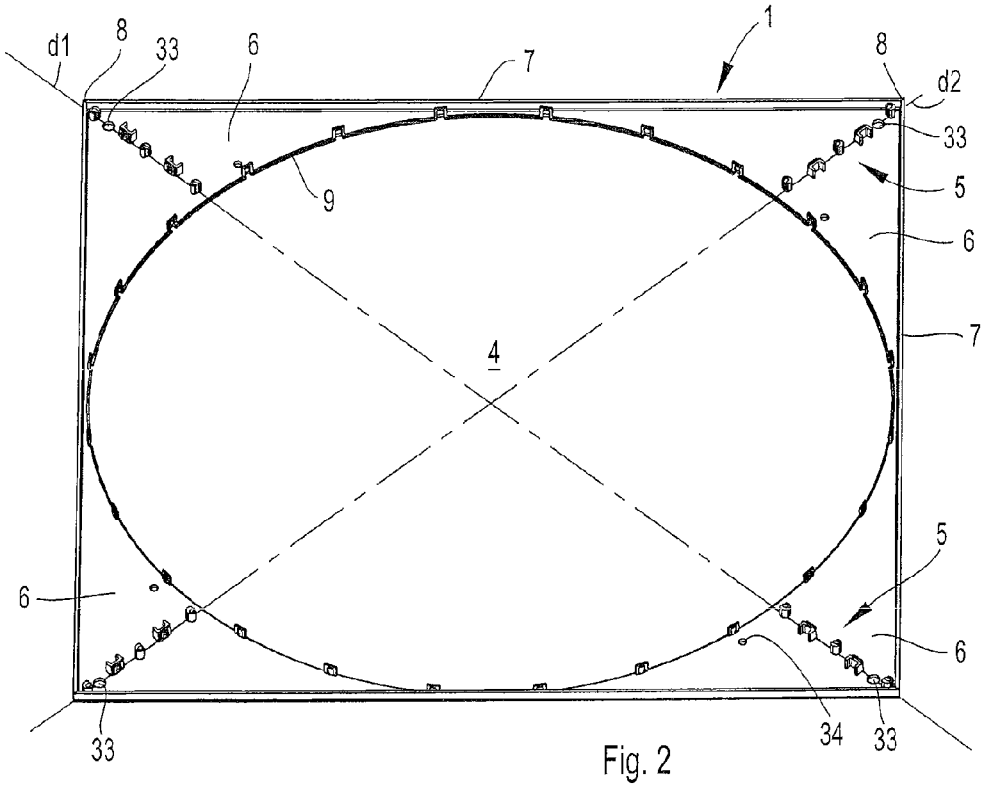
FIG. 2 is a view of an inventive supporting ring.
Figure 3:
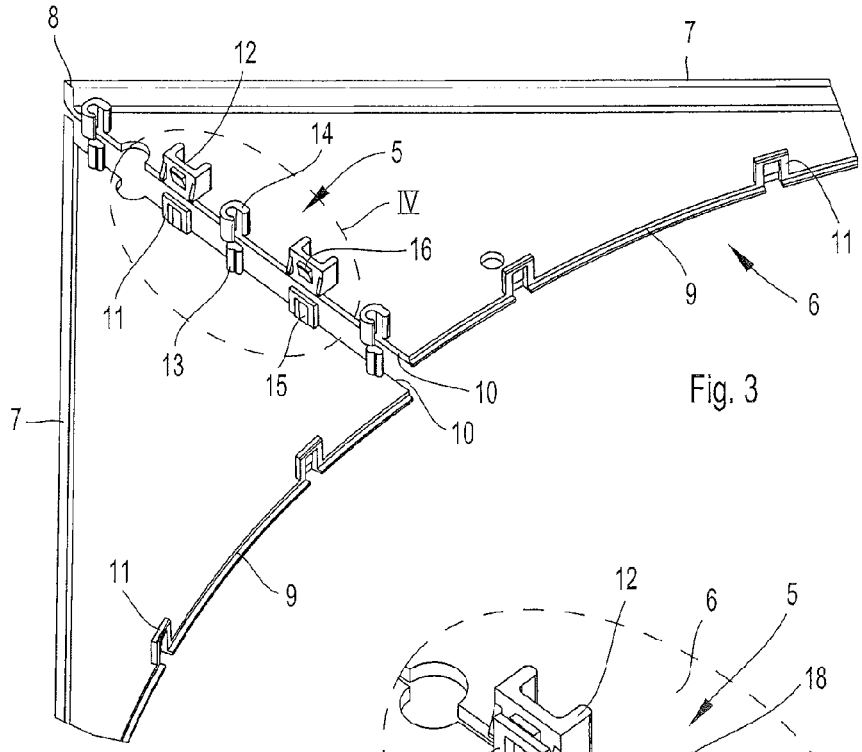
FIG. 3 is a partial view of the inventive supporting frame according to FIG. 2 before the frame elements are fit together.

FIG. 1 shows an inventive wall-ring. It is comprised of a supporting frame 1, to which a circular connecting piece 2 is attached by means of form and force-fitting connecting elements 3. The supporting frame 1 encompasses a circular opening 4. The supporting frame 1, in turn, is comprised of a plurality of frame elements 6 that are connected to each other by means of form and force-fitting frame elements 5. Here, it is advantageous if the supporting frame 1 has a rectangular, in particular a quadratic contour, so that it has four frame edges 1 that are, in particular, of the same length, as well as four corners 8. The supporting frame being subdivided along its two diagonals d1, d2 through the corners 8 into the four frame elements 6 results in four structurally identical, or two times two structurally identical frame elements 6 with an inner curved boundary edge 9 corresponding to a quadrant. Furthermore each frame element 6 has lateral connecting edges 10, which, in an assembled state, accordingly coincide with the diagonals d1 and d2 and enclose, together with the frame edge 7, an angle of 45°. The diameter of the opening 4 and the internal diameter of the circular connecting piece 2 are adjusted in the conventional manner to the diameter of a blade wheel of an axial fan that is to be mounted. It can also be seen that holes 33 are formed in the corner regions of the supporting frame, through which fixing elements can be passed when the supporting frame 1 is attached to a housing wall or such.

The connecting elements 5 are provided in the end region of the lateral connecting edges 10, said connecting elements being comprised of the locking elements 11, 12, and the guide elements 13, 14, so that the frame elements 6 can be form and force-fittingly connected to each other. The locking elements that are designed as locking lugs 11 on a lateral connecting edge 10 of a frame element 6 interact with locking receiving members 12, which are formed on the lateral connecting edge 10 of the other adjacent frame element 6. The same applies to the guide elements 13, 14, which, as guide pins 13 of the one frame element 6 in the region of its lateral connecting edge 10, interact with the associated pin holes 14 on the lateral connecting edge 10 of the other frame element 6. The locking lugs 11 have a center opening 15, with which the latch cams 16 of the receiving members 12 engage in an assembled state, whereby the locking lugs 11 are guided between border projections 17 on both sides of the latch cam 16. The pin holes 14 have a passage opening 18 that is open on one side. The guide pin 13 has a guide extension 19, through which runs the region of the passage opening that is open at the side, so that a form and force-fitting connection is made between the guide extension 19 and the pin hole 14.

Figure 4:
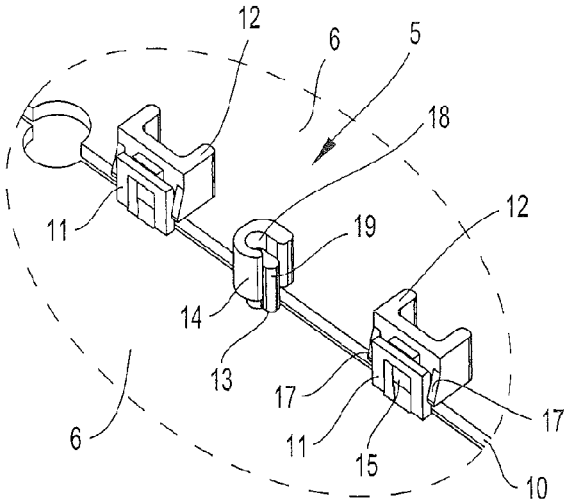
FIG. 4 is a partial view according to IV in FIG. 3.
Figure 5:
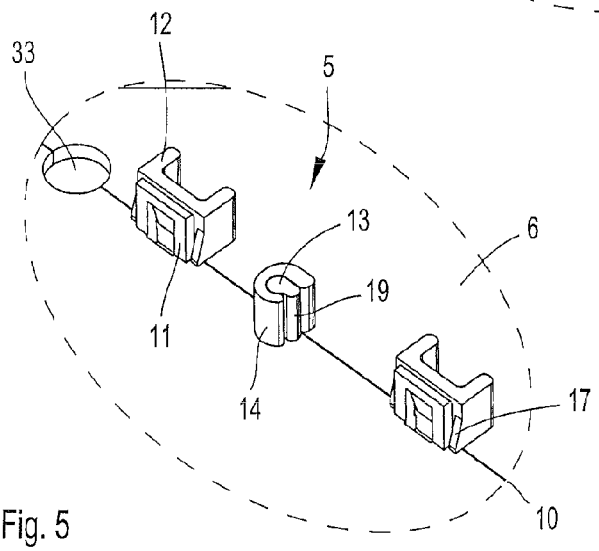
FIG. 5 is a view corresponding to the partial view according to FIG. 4, however in the assembled state of the frame elements.

FIGS. 4 and 5 show the inventive embodiment of the connecting elements 11, 12 and the guide elements 13, 14.

Thus in terms of the invention, the frame elements 6, particularly in the case of the quadratic design, are all of identical construction and can be manufactured using the same molding tools, for example by means of injection molding. With the rectangular design, there are, per supporting frame 1, two times two identical frame elements 6. There is an additional advantage in that this design simplifies warehousing, and transport volume is very small. Furthermore, the frame elements 6, in the region of their circular boundary edge 9, have a plurality of locking lugs 11 that run vertically to the surface of said frame elements that interact with adapted catch holders on the circular connecting piece 2. These locking lugs 11 and receiving members are formed, corresponding to the connecting elements 11, 12 on the lateral connecting edges 10, and also on the frame elements in the region of the boundary edges. The circular connecting piece 2 is comprised of a cylindrical section 20, as well as an arched, circular junction part 21 that runs in the axial direction of its central axis X-X between said cylindrical section and the supporting frame 1, producing a nozzle-shaped contour. Inventively, the circular connecting piece 2 is comprised of a plurality of circular segments 22. Advantageously, at least eight circular segments 22 are employed, resulting in a 45° division. In the preferred exemplary embodiment shown, the connecting piece 2 is comprised of twelve single circular segments 22, so that there is a 30° division; the side edges 23, 24 that rest next to each other in the region of the cylindrical section 20 being in each case connected via connecting elements 25, 26.

The connecting elements 25, 26 are comprised of outwardly projecting guide bars 25 running parallel to the side edge 23 that can be inserted into a guide groove of a guide bar 26 with a U-shaped cross section on the side edge 24 of the adjacent circular segment. There are guide elements 29, 30 in the region of the junction part 21, in particular on the adjacent side edges 23, 24, whereby the guide elements of the side edge 23 are designed as guide pins 29, and the corresponding guide elements on the side edge 24 are designed as pin holes 30. These guide elements 29, 30 can also be designed as corresponding to the guide elements 13, 14.

At the free end of the junction section 21, the circular segments 22 have an arched side edge 31 that belongs to an attachment section 32, where the circular segment 22 rests on the supporting frame 1 in the edge region of the opening 4. On this attachment section 32, the receiving members 12 are formed on the side facing away from the supporting frame 1, said receiving members connecting in a form and force-fitting manner to the locking lugs.

Figure 6:
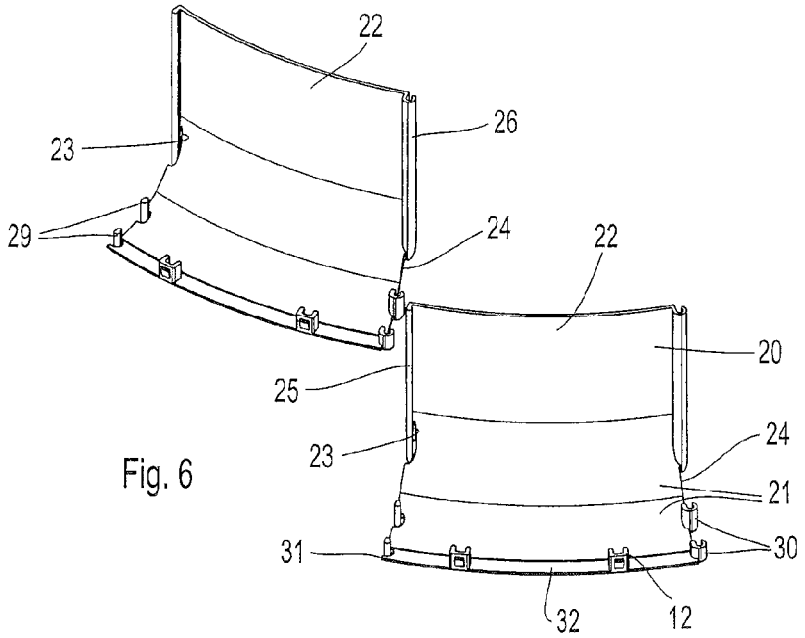
FIG. 6 is a view of two inventive circular segments before they have been fit together.
Figure 7:
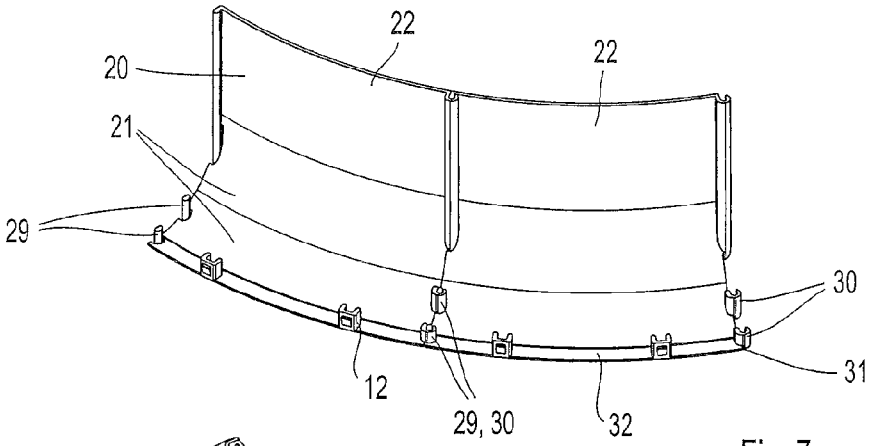
FIG. 7 is a view of two circular segments after assembly.
Figure 8:
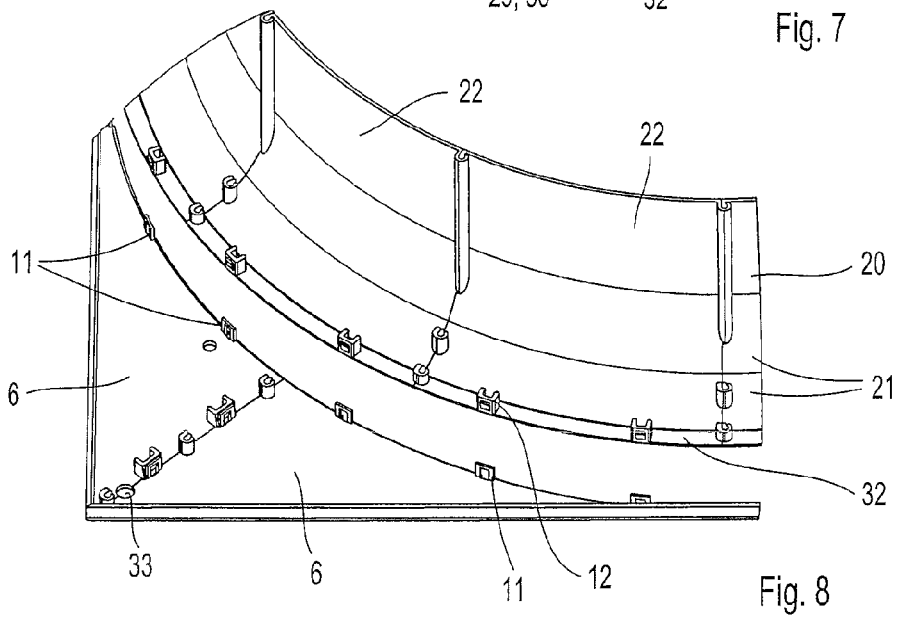
FIG. 8 is a partial view of two frame elements that have been fit together and two assembled circular segments before a connection has been made between the supporting frame and the circular connecting piece.

The inventive circular segments 22 are all of identical construction, so that they can be produced using the same tools, for example, by means of injection molding or vacuum extraction, which results, on the one hand, in low manufacturing costs, and on the other hand in significant reduction of transport costs. When mounting the inventive wall-ring, the supporting frame 1 and the circular connecting piece 2 are first assembled from their individual frame elements 6 or circular segments 22, respectively, and then firmly connected to each other via the existing connecting and guide elements 11, 12, 13, 14, and/or 25, 26, 29, 30, producing a stable wall ring (cf. FIG. 1). For mounting, the frame elements 6 that are to be connected are aligned on their attachment sides with a slight height offset, so that the locking lugs 11 are arranged below the receiving members 12, and the guide pins 13 lie below the respective pin holes 14. Then the connecting elements 11, 12 and the guide elements 13, 14 are slid into each other and the connection formed in this way. When connecting the circular segments, there is again alignment of the two circular segments 22 that are to be mounted with a height-offset such that the guide bar 25 is arranged on a side edge of a circular segment 22 below the guide rail 26, and the guide pins 29 below the pin holes 30. Then the lower circular segment that is part of the guide bar 25 is slid in such a way in the direction of the circular segment 22 with the guide rail 26, that the guide bar 25 is inserted into the guide rail 26, and at the end of the connection process, the guide pins 29 mesh with the associated pin holes 30 such that attachment takes place. Reference can be made here to FIGS. 6 and 7.

Figure 9:
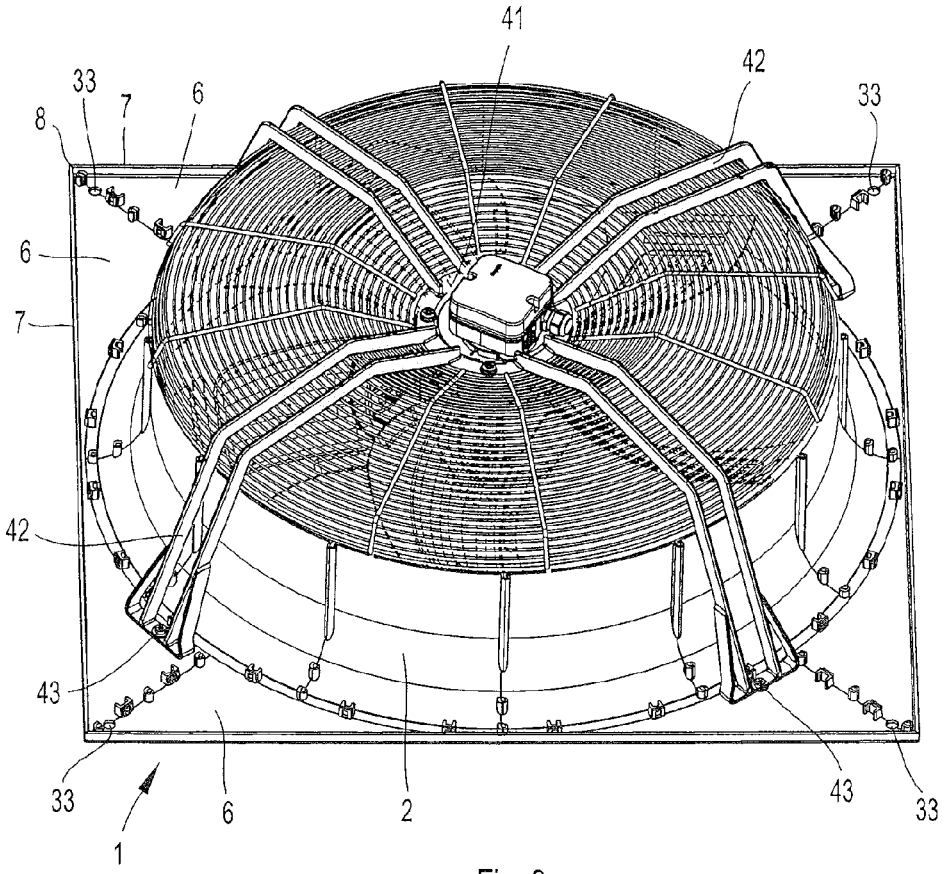
FIG. 9 is a perspective view of an inventive wall-ring with an axial fan arranged inside it.

FIG. 9 shows how an axial fan 41 is attached by means of supporting braces to a supporting frame 1. The supporting braces 42 are screwed using screws 43 onto the supporting frame 1, screw-inserts 32 being provided in the supporting frame 1 and said screws 43 are screwed into the screw-inserts. The frame elements 6 and the circular segments 22 are comprised of plastic, preferably polypropylene which is, in particular, reinforced with fiberglass, and said elements are manufactured as injection-molding parts, or by using vacuum forming.

Figure 10:
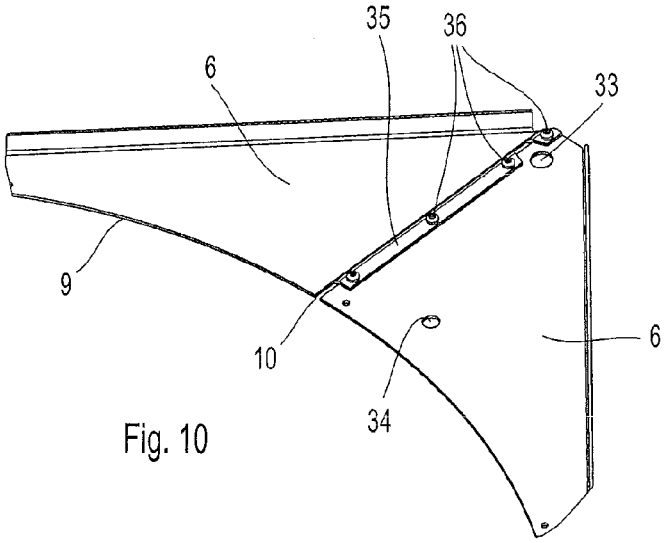
FIG. 10 is a partial view of an additional inventive embodiment of the supporting frame.

FIG. 10 shows a corresponding partial view of an additional embodiment of the inventive supporting frame 1. Here, the in particular four frame elements 6 are made of sheet-metal sections that can correspond, in their form, to the frame elements 6 as described in FIGS. 1-9. In order to connect the frame elements 6 to each other in the region of the lateral connecting edges 10, the one frame element has, along its lateral connecting edge 10, a connecting tongue 35 or a plurality of consecutively arranged connecting tongues 35 that covers or overlaps the adjacent frame element 6 at its lateral connecting edge 10, whereby the connecting tongue or connecting tongues 35 is or are offset to a degree that corresponds to the thickness of the sheet-metal sections, so that the frame elements 6 are aligned with each other and lie in the same plane. In the overlap region of the connecting tongue or connecting tongues 35, screw or rivet connections that run through the connecting tongue or connecting tongues 35 and the respective covered frame element 6 are provided for the interconnection of the frame elements 6. However, the connection can also be made by means of welding or cold forming. Alternatively to the connection according to FIGS. 1-9, the connection described above, like that between the frame elements 6, can also be made between the frame elements 6 and the circular segments 22 of the connecting piece 6, if in particular the circular segments 22 are also made of sheet-metal sections. Here, the screw or rivet connections are then provided in the region of the attachment section 32. In this region, there can also be a connection by means of welding or cold forming.

Instead of the connecting elements between the frame elements 6 on the one hand and the frame elements and the circular segments 22 on the other as represented in connection with FIGS. 1-9, there can also be screw, rivet, welded and/or cold-formed connections, for example corresponding to the embodiment according to FIG. 10.

While the above description constitutes the preferred embodiment of the present invention, it will be appreciated that the invention is susceptible to modification, variation and change without departing from the proper scope and fair meaning of the accompanying claims.

The invention claimed is:

1. A wall ring for an axial fan comprising a supporting frame (1), on which a circular connecting piece (2) is formed, with the axial fan arranged therein, the supporting frame (1) is assembled from a plurality of frame elements (6) by first form and force-fitting connecting elements (11, 12, 35, 36), and the circular connecting piece (2) is formed of a plurality of circular segments (22) arranged circumferentially one after the other, the circular segments being connected to each other and with the supporting frame (1) by second form and force-fitting, or material-bonded connections, or by second connecting elements (25, 26, 35, 36), wherein the frame elements (6) have an arched circular boundary edge (9) with a plurality of the first connecting elements in the form of locking lugs (11) running vertically to a surface of the frame elements, the locking lugs (11) interacting with adapted locking receiving members (12) on the circular connecting piece (2).

2. The wall ring according to claim 1, wherein the circular connecting piece (2) is includes an arched cylindrical section (20) and a circular junction part (21) that runs in an axial direction (X-X) between the cylindrical section and the supporting frame (1).

3. The wall ring according to claim 1, wherein the circular connecting piece (2) is assembled from twelve circular sections (22).

4. The wall ring according to claim 1, wherein the frame elements and the circular segments (22) and the first connecting elements (11, 12 and 25, 26, 35, 36), have guide elements (13, 14 and 29, 30) for reciprocal guiding.

5. The wall ring according to claim 1, wherein the frame elements (6) are structurally identical among one another, and the circular segments (22) are also structurally identical among one another.

6. The wall ring according to claim 1, wherein the first connecting elements (11, 12) include locking lugs (11) on one lateral connecting edge (10) of a frame element (6) and locking receiving members (12) on a lateral connecting edge of an adjacent frame element (6).

7. The wall ring according to claim 6, wherein the frame elements (6) near their lateral connection edges (10) have guide elements that include guide pins (13) and associated pin holes (14), wherein at least one of the guide pins (13) on a first of the frame elements (6) is formed near the lateral connecting edge (10) and at least one of the pin holes (14) is formed on the lateral connecting edge (10) of a second of the frame elements (6).

8. The wall ring according to claim 1, wherein the locking lugs (11) have a center opening (15) into which latch cams (16) of locking receiving members (12) engage in an assembled state.

9. The wall ring according to claim 1, wherein the circular segments (22) have an arched circular side edge (31) at a free end of their junction part (21) that belongs to an end-side flat attachment section (32) on which the circular segment rests on the supporting frame (1) in an edge-region of the opening (4).

10. The wall ring according to claim 1, wherein the circular segments are connected by the second connecting elements and wherein the second connecting elements (25, 26) of the circular segments (22) include outwardly projecting guide bars (25) that run parallel to a side-edge (23) of a first of the circular segments, the guide bars being displaced into a guide slot of a guide rail (26) with a U-shaped cross-section on a edge-side of an adjacent second of the circular segments (22).

11. The wall ring according to claim 1, wherein the locking receiving members (12) that interact with the locking lugs (11) are formed on an attachment section (32) on a side facing away from the supporting frame (1).

12. The wall ring according to claim 10, wherein near the junction part (21), guide elements (29, 30) are formed on the adjacent side-edges (23, 24) of the circular segments, the guide elements of the side-edge (23) including guide pins (29) and the corresponding guide elements on the other side-edge (24) including pin holes (30).

13. The wall ring according to claim 1, wherein the frame elements (6) and the circular segments (22) are made of polypropylene, by injection molding or vacuum forming.

14. The wall ring according to claim 1, wherein the frame elements (6) are connected to the circular segments (22) by screw or rivet connections (36) or by welding or cold-forming.

15. A wall ring for an axial fan comprising a supporting frame (1), on which a circular connecting piece (2) is formed, with the axial fan arranged therein, the supporting frame (1) is assembled from a plurality of frame elements (6) by first form and force-fitting connecting elements (11, 12, 35, 36), and the circular connecting piece (2) is formed of a plurality of circular segments (22) arranged circumferentially one after the other, the circular segments being connected to each other and with the supporting frame (1) by second form and force-fitting, or material-bonded connections, or by second connecting elements (25, 26, 35, 36), wherein in order to connect the frame elements (6) to each other at lateral connecting edges (10) thereof, a first of the frame elements (6) has one or a plurality of connecting tongues (35) that cover or overlap, respectively, a second of the frame elements (6), and that in the overlapping region, the connection between the frame elements (6) is made by means of screw or rivet connections (36) or by means of welding or cold-forming.

16. The wall ring according to claim 15, wherein the supporting frame (1) has a rectangular quadratic circumferential contour (7) with four corners (8) and a center opening (15), wherein four broadened corner regions are formed, and the frame elements (6) are formed by a division along diagonals (d1, d2) that run through the corners of the supporting frame (1).

17. The wall ring according to claim 15, wherein the frame elements (6) or the circular segments (22) are made of tailor-cut sheet-metal.

18. The wall ring according to claim 15, the circular segments are connected by the second connecting elements and wherein the second connecting elements (25, 26) of the circular segments (22) include outwardly projecting guide bars (25) that run parallel to a side-edge (23) of a first of the circular segments, the guide bars being displaced into a guide slot of a guide rail (26) with a U-shaped cross-section on a edge-side of an adjacent second of the circular segments (22).

19. The wall ring according to claim 18, wherein the frame elements (6) are connected to the circular segments (22) by screws, rivets, a welding connection or a cold-forming connection.

* * * * *